US006000413A

United States Patent [19]

Chen

[11] Patent Number: 6,000,413

[45] Date of Patent: Dec. 14, 1999

[54] FUEL INJECTOR CLEANING SYSTEM

[75] Inventor: Ieon C. Chen, Laguna Hills, Calif.

[73] Assignee: Innova Electronics Corporation, Fountain Valley, Calif.

[21] Appl. No.: 09/145,144

[22] Filed: Sep. 1, 1998

[51] Int. Cl.[6] ..... B08B 9/02

[52] U.S. Cl. ..... 134/102.2; 134/113; 134/169 A; 222/81; 222/400.7; 239/309; 239/373

[58] Field of Search ..... 134/102.2, 113, 134/169 R, 169 A; 123/198 A; 222/81, 82, 400.7, 396, 399; 239/309, 373

[56] References Cited

U.S. PATENT DOCUMENTS

| | | | |
|---|---|---|---|
| 2,057,874 | 10/1936 | Barks et al. | 134/169 R X |
| 4,022,258 | 5/1977 | Steidley | 222/81 X |
| 4,520,773 | 6/1985 | Koslow | 123/198 |
| 4,671,230 | 6/1987 | Turnipseed | 123/198 |
| 4,809,539 | 3/1989 | Goodman | 123/198 A X |
| 4,920,996 | 5/1990 | Flanner | 134/22.11 |
| 4,989,561 | 2/1991 | Hein et al. | 123/198 |
| 4,995,915 | 2/1991 | Sewell et al. | 134/22.14 |
| 5,022,364 | 6/1991 | Phillips | 123/198 |
| 5,090,377 | 2/1992 | Pearson | 123/198 |
| 5,091,017 | 2/1992 | Flanner | 134/22.11 |
| 5,232,513 | 8/1993 | Suratt et al. | 134/21 |
| 5,257,604 | 11/1993 | Vataru et al. | 123/198 |
| 5,401,324 | 3/1995 | Huddas | 134/21 |
| 5,452,696 | 9/1995 | Flynn | 123/198 |
| 5,485,857 | 1/1996 | Amundsen | 134/169 A X |
| 5,503,683 | 4/1996 | Butcher et al. | 134/22.12 |
| 5,516,370 | 5/1996 | Karnauchow et al. | 134/169 A X |
| 5,803,310 | 9/1998 | Soon | 222/81 X |
| 5,829,460 | 11/1998 | Acevedo | 134/102.2 |
| 5,833,765 | 11/1998 | Flynn et al. | 134/169 A X |

*Primary Examiner*—Philip R. Coe
*Attorney, Agent, or Firm*—Stetina Brunda Garred & Brucker

[57] ABSTRACT

An automotive cleaning and pressure check device for placing the interior of a canister into fluid communication with an internal combustion engine via a fluid hose. The cleaning and pressure check device comprises a manifold body having first and second fluid ducts extending therethrough. Attached to the manifold body is a first coupling member. The fluid hose is releasably attachable to the first coupling member and placeable into fluid communication with the first fluid duct thereby. Also attached to the manifold body are an elongate fluid tube and a pressure gauge, both of which are fluidly connected to the first fluid duct. A pressure regulator is also attached to the manifold body and fluidly connected to the second fluid duct. The pressure regulator is operable to selectively place the second fluid duct into fluid communication with at least one of a pressurized air source and ambient air. Disposed within the manifold body is a shut-off valve which is operable to selectively block the flow of fluid between the fluid tube and the first coupling member, and a safety check valve which is operable to selectively block the flow of fluid through the second fluid duct. The manifold body is configured to permit the releasable attachment of the canister thereto in a manner wherein the fluid tube extends into the interior of the canister and the second fluid duct is in fluid communication therewith.

9 Claims, 3 Drawing Sheets

FUEL INJECTOR CLEANING SYSTEM

FIELD OF THE INVENTION

The present invention relates generally to the electronic fuel injection systems of automobile internal combustion engines, and more particularly to a device and technique which is particularly suited for cleaning fuel injectors, and is further usable for performing engine decarbonizing and fuel pressure check functions.

BACKGROUND OF THE INVENTION

For some time, it has been recognized in the prior art that controlled fuel injection, particularly that of the electronic type, is best suited for meeting the often conflicting demands of fuel economy, high engine performance, and allowable emissions in modern automobiles. Fuel injectors, on which electrically controlled fuel injection systems rely, essentially consist of three basic parts, i.e., an electromagnet, a needle valve, and a nozzle. The electromagnet is activated, for example, by a signal from an electronic control unit which moves the injector's needle valve sufficiently away from the opening in the nozzle to allow the injection or delivery of fuel in the form of a fine spray. The exact amount of fuel required for any given operating condition can be introduced based on information obtained from data delivered to the control unit from sensors located at multiple points throughout the engine and exhaust system. The result is an extremely efficient method for controlling engine performance.

Despite their superior performance, fuel injectors possess certain deficiencies which detract from their overall utility. Perhaps the most significant of these deficiencies is the tendency for unwanted deposits to accumulate in the nozzle area, thus resulting in nozzle clogging which causes rough idling, as well as hesitation of the engine during acceleration. In this regard, injector nozzles are manufactured to extremely fine tolerances, and even small amounts of foreign particles tend to result in their malfunction. Additionally, poor fuel quality, as well as ordinary operating conditions tend to be responsible for the unwanted accumulation of varnishes and other contaminants of the type described. These accumulations must be removed periodically if continued optimum performance of the injectors, and hence the engine, is to be achieved.

There is currently known in the prior art a wide range of fuel injector cleaning systems which employ any one of a variety of different cleaning techniques. The cleaning technique employed by one prior art cleaning system involves pouring a quantity of cleaning fluid directly into the gas tank of the automobile. The cleaning fluid mixes with the gasoline, and ultimately reaches the fuel injectors via the circulation of the gasoline through the fuel system. However, because of the requirement that the cleaning fluid formulation does not corrode the rubber hosing leading from the fuel tank to the fuel injectors, the formulation is relatively dilute, particularly when diluted by a significant amount of gasoline in the tank. As will be recognized, such dilution seriously compromises the efficacy of the formulation in dissolving contaminant deposits in the engine.

In view of the shortcomings of the above-described cleaning technique, a variety of cleaning systems/techniques have been developed in the prior art for injecting a more concentrated cleaning fluid solution directly into the fuel rail to which the fuel injectors are connected. In one such prior art system, the cleaning fluid is contained within a pressurized aerosol can which is connected to the fuel rail through a pressure regulator. However, these types of prior art cleaning systems have deficiencies relating to the use of aerosols which may be ozone unfriendly, the common inability to deliver all of the fluid in the aerosol can, the higher pressure at which the aerosol is typically provided (i.e., about 120 psi), the cost of the pressurized aerosol can, and the wear imposed on the plastic/rubber pieces of the pressure regulator of the system as the cleaning fluid passes therethrough.

Another currently known prior art cleaning system/technique eliminates the use of the pressurized can, instead making use of a pressurized air supply typically found in automotive shops. More particularly, a cylinder is filled with a quantity of cleaning fluid, with a pressurized air source then being introduced at one end of the cylinder to facilitate the discharge of pressurized cleaning fluid from the other end thereof. An in-line pressure gauge is typically disposed within the discharge line. However, these types of prior art cleaning systems/techniques also suffer from certain drawbacks. These deficiencies include the common need to transfer the cleaning fluid from its original container into the cylinder of the cleaning system. Such transfer is undesirable due to the highly flammable and corrosive nature of the cleaning fluid and the risk of inadvertent spillage during the transfer process. Additionally, the in-line pressure gauge as well as other components in such cleaning systems are extremely difficult to replace. In this respect, fuel line pressure specifications vary with the make of the automobile engine, thus often requiring the substitution of the pressure gauge with one adapted to provide pressure readings in a different range. Finally, because they comprise numerous components and adapters, these types of cleaning systems are often expensive to assemble, difficult to use, and incapable of performing alternative functions such as engine decarbonizing and fuel pressure checks. Though certain prior art cleaning systems may be configured so as to avoid the need to transfer the cleaning fluid from one container to another, they are still deficient in that the user thereof is subjected to substantial exposure to the fumes of the cleaning fluid during the process of setting up the cleaning system.

The present invention addresses and overcomes these and other deficiencies of prior art cleaning systems/techniques. More particularly, in the present invention, use is made of a cleaner container or canister which is provided with a safety cap adapted to have a single opening formed therein on demand into which pressurized air is injected and cleaning fluid is discharged, thus avoiding the need of pouring the highly flammable and corrosive cleaning fluid from one container to another, or exposing the user to the fumes from the cleaning fluid. The source of pressurized air for the present invention is that found in the shop (i.e., "shop air"), and is regulated to a desired pressure level. A connecting manifold is provided in the present invention which allows for the direct connection/disconnection of the pressurized air source, cleaning fluid canister, discharge line and pressure gauge thereto. Any of the four (4) ports of the manifold can be connected/disconnected without disturbing connections to the other three (3) ports. For example, where the fuel pressure should be more properly measured in another range, the pressure gauge can be quickly and easily replaced without removing the connection to the cleaning fluid canister. Also provided in the manifold is a shut-off valve and a safety check valve. The shut-off valve allows for the use of the present invention for other applications, including engine decarbonizing and fuel pressure checks. The safety check valve prevents the interior of the cleaning fluid canister from being pressurized in the event the same is not fully threadably engaged to the manifold.

As such, the present invention has the advantages of being compact, easy to use, safe, cheaper to build, and avoiding the need for expensive and/or pressurized containers, while substantially eliminating the risk of spilling the highly flammable and corrosive cleaning fluid since it need not be transferred from one container to another. The present invention also avoids the exposure of the user to the cleaning fluid fumes, allows for the quick and easy connection/disconnection of components, and preserves the life of the pressure regulator by avoiding the exposure thereof to the corrosive cleaning fluid. These, and other advantages associated with the present invention, will be discussed in more detail below.

SUMMARY OF THE INVENTION

In accordance with the present invention, there is provided an automotive cleaning and pressure check device for placing the interior of a canister into fluid communication within an internal combustion engine via a fluid hose. The present device is capable of performing multiple functions, including fuel injector cleaning, engine decarbonizing, and fuel pressure checks. If used for fuel injector cleaning or engine decarbonizing, the canister used in conjunction with the device, though being of a standard size and configuration and filled with either a fuel injector cleaning fluid or an engine decarbonizing solvent, is further provided with a safety cap which is mounted within the externally threaded neck portion thereof. The safety cap includes a main web portion and a thin-walled, piercable puncture region which is diposed within the main web portion. The safety cap is also provided with an O-ring which extends thereabout and is fabricated from a resilient material such as rubber, with the remainder of the safety cap preferably being fabricated from a plastic material. If the device is used for conducting a fuel pressure check, the canister used in conjunction therewith is an empty bleed canister which is preferably fabricated from either a transparent or semi-transparent material and is also provided with the safety cap.

In the preferred embodiment, the cleaning and pressure check device of the present invention comprises a manifold body having first and second fluid ducts extending therethrough. Attached to the manifold body are identically configured first and second coupling members, each of which comprises a quick-connect type coupling. One end of the fluid hose is releasably attachable to the first coupling member and placeable into fluid communication with the first fluid duct thereby. Additionally, a pressure gauge of the present cleaning and pressure check device is releasably attached to the second coupling member and placed into fluid communication with the first fluid duct thereby.

The cleaning and pressure check device of the present invention further comprises an elongate fluid tube which has a beveled distal end or tip. The fluid tube is attached to the manifold body and fluidly connected to the first fluid duct. Also included in the cleaning and pressure check device is a pressure regulator which is also attached to the manifold body and fluidly connected to the second fluid duct. The pressure regulator is operable to selectively place the second fluid duct into fluid communication with either a pressurized air source or ambient air. Further, disposed within the manifold body is a shut-off valve which is operable to selectively block or close off the flow of fluid between the fluid tube and the first coupling member. Also disposed within the manifold body, and more particularly the second fluid duct defined thereby, is a safety check valve which is operable to selectively block the flow of fluid through the second fluid duct. The safety check valve is movable between a closed position whereat the flow of fluid through the second fluid duct is blocked thereby, and an open position whereat the flow of fluid through the second fluid duct is unobstructed. The manifold body may optionally include a hanger member which is attached thereto and used to suspend the same from a support structure such as the hood of an automobile.

In the present cleaning and pressure check device, the manifold body is configured to permit the releasable attachment of the canister thereto in a manner wherein the fluid tube extends into the interior of the canister and the second fluid duct is in fluid communication therewith. As indicated above, the canister includes an externally threaded neck portion into which the safety cap is rigidly mounted. The manifold body itself includes an internally threaded recess formed therein which circumvents the fluid tube and is sized to threadably engage the neck portion for facilitating the releasable attachment of the canister to the manifold body. One end of the second fluid duct terminates at the innermost wall of the manifold body defining the recess so as to place the second fluid duct into fluid communication with the interior of the canister when the neck portion thereof is threadably received into the recess.

The releasable attachment of the canister to the manifold body is accomplished by puncturing the piercable puncture region of the safety cap mounted within the neck portion of the canister with the beveled distal tip of the fluid tube, and thereafter advancing the fluid tube into the interior of the canister. When the fluid tube is advanced through the puncture region of the safety cap, a slight gap is defined between the safety cap and the outer surface of the fluid tube. The externally threaded neck portion of the canister is then screwed into the recess of the manifold body. As the neck portion is received into the recess, a push pin portion of the safety check valve which protrudes into the recess of the manifold body is contacted by the main web portion of the safety cap and pushed or advanced thereby into the portion of the second fluid duct adjacent the recess. The force of such advancement overcomes the biasing force exerted by a biasing spring of the safety check valve against a ball member thereof from which the push pin portion extends, thus unseating the ball member from that portion of the second fluid duct adjacent the recess and hence creating an unobstructed flow path between the pressure regulator and the recess. Air entering the recess via the second fluid duct flows into the interior of the canister via the gap defined between the outer surface of the fluid tube and the safety cap, thus pressurizing the contents of the canister. Importantly, the push pin portion of the safety check valve is sized such that it will not be acted upon by the main web portion of the safety cap in the above-described manner until such time as the neck portion of the canister is fully threadably received into the recess of the manifold body. The O-ring of the safety cap creates a fluid-tight seal against the manifold body when the canister is fully threadably received thereinto.

In the manifold body of the present cleaning and pressure check device, the second fluid duct preferably has a generally L-shaped configuration, with the first fluid duct preferably having a generally T-shaped configuration. In this respect, the first fluid duct defines a first segment which fluidly communicates with the first coupling member and a second segment which fluidly communicates with the fluid tube. In addition to the first and second segments, the first fluid duct defines a third segment which fluidly communicates with the pressure gauge, and a junction whereat the first, second and third segments fluidly communicate with each other. The shut-off valve is preferably disposed within the second segment of the first fluid duct.

Further in accordance with the present invention, there is provided a method for cleaning the fuel injectors of the fuel system for an internal combustion engine through the use of the cleaning and pressure check device having the previously described structural attributes. The fuel injector cleaning method comprises the initial step of suspending the manifold body from a support structure such as an automobile hood, and thereafter releasably attaching a selected pressure gauge to the second coupling member based on the fuel rail pressure specifications of the vehicle. The pressure regulator is then actuated to a closed position, which is followed by the actuation of the shut-off valve to an open position. Thereafter, a canister filled with a quantity of fuel injector cleaning fluid and including the above-described safety cap is releasably attached to the manifold body via the threadable receipt of the neck portion thereof into the recess of the manifold body. Such threadable engagement results in the extension of the fluid tube into the interior of the canister, the opening of the safety check valve, and the placement of the second fluid duct into fluid communication with the interior of the canister.

Subsequent to the attachment of the canister to the manifold body in the above-described manner, a pressurized air source is releasably attached to the pressure regulator. Thereafter, the first fluid duct of the manifold body is fluidly connected to the fuel rail of the fuel system by releasably attaching the opposed ends of an elongate hose to respective ones of the first coupling member and the fuel rail. The return line of the fuel system is then clamped-off, with the fuel pump of the fuel system then being disabled.

Subsequent to the disabling of the fuel pump of the fuel system, the pressure regulator is actuated to an open position and adjusted as needed to correlate the pressure reading provided by the pressure gauge to a prescribed pressure level range for the fuel rail as indicated by the vehicle specifications. The opening of the pressure regulator causes air pressure to be exerted against the cleaning fluid in the canister which forces the same into the fuel rail via the fluid tube, first fluid duct, and hose. The engine is then started, with the pressure regulator being adjusted or fine tuned subsequent to the starting of the engine as needed to maintain the pressure reading of the pressure gauge within the prescribed pressure level range.

Still further in accordance with the present invention, there is provided a method for decarbonizing an internal combustion engine through the use of the cleaning and pressure check device having the previously described structural attributes. The engine decarbonizing method comprises the initial step of suspending the manifold body from a support structure such as an automobile hood, and thereafter actuating the pressure regulator to an open position. A canister filled with a quantity of decarbonizing fluid and including the above-described safety cap is then releasably attached to the manifold body via the threadable receipt of the neck portion thereof into the recess of the manifold body. Such threadable engagement results in the extension of the fluid tube into the interior of the canister, the opening of the safety check valve, and the placement of the second fluid duct into fluid communication with the interior of the canister.

Subsequent to the attachment of the canister to the manifold body, the shut-off valve is actuated to a closed position, with the first fluid duct of the manifold body then being fluidly connected to the engine manifold of the engine by releasably attaching the opposed ends of an elongate hose to respective ones of the first coupling member and the vacuum port of the engine manifold. The engine is then started, with the shut-off valve thereafter being slowly actuated to an open position so as to facilitate the flow of the decarbonizing fluid into the engine manifold. The decarbonizing fluid is drawn from the canister into the engine manifold via the fluid tube, first fluid duct and hose by the vacuum created by the starting of the engine.

Still further in accordance with the present invention, there is provided a method of checking the pressure of the fuel system of an internal combustion engine through the use of the cleaning and pressure check device having the previously described structural attributes. The fuel pressure check method comprises the initial step of suspending the manifold body from a support structure such as an automobile hood, and thereafter releasably attaching a selected pressure gauge to the second coupling member based on the fuel system pressure specifications of the vehicle. The shut-off valve is then actuated to a closed position. Thereafter, an empty bleed canister including the above-described safety cap is releasably attached to the manifold body via the threadable receipt of the neck portion thereof into the recess of the manifold body. Such threadable engagement results in the extension of the fluid tube into the interior of the canister, the opening of the safety check valve, and the placement of the second fluid duct into fluid communication with the interior of the canister.

Subsequent to the attachment of the canister to the manifold body, the pressure regulator is actuated to an open position. The first fluid duct of the manifold body is then fluidly connected to the fuel rail and the fuel line of the fuel system by releasably attaching one end of an elongate hose to the first coupling member, releasably attaching the other end of the hose to a T-connector, releasably attaching the T-connector to the fuel rail, and releasably attaching the fuel line to the T-connector. The engine is then started.

After the engine has been started, the shut-off valve is actuated to an open position to bleed off air from within the hose and the first fluid duct. The opening of the shut-off valve causes such air to flow into the interior of the canister and out to ambient air via the second fluid duct and open pressure regulator. Upon the visual observation of the flow of fuel or gasoline into the canister, the shut-off valve is actuated back to the closed position. Thereafter, a pressure reading provided by the pressure gauge is correlated to the prescribed fuel pressure range for the fuel system.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
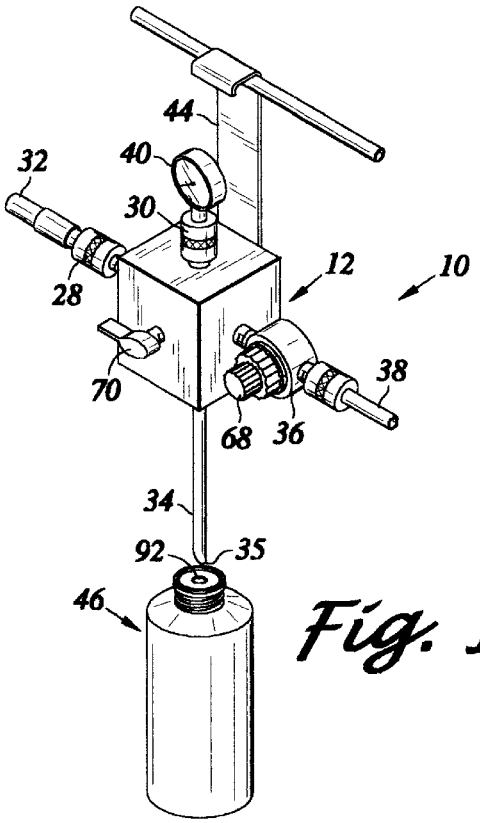
FIG. 1 is a front perspective view of the cleaning and pressure check device constructed in accordance with the present invention.
Figure 1A:
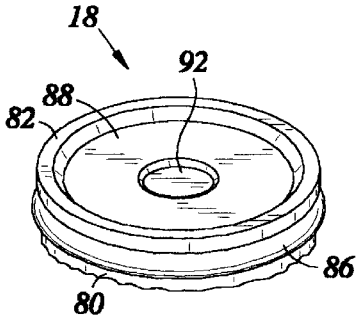
FIG. 1*a* is a top perspective view of the safety cap of the canister preferably used in conjunction with the cleaning and pressure check device of the present invention.

Referring now to the drawings wherein the showings are for purposes of illustrating a preferred embodiment of the present invention only, and not for purposes of limiting the same, FIG. 1 perspectively illustrates a cleaning and pressure check device 10 constructed in accordance with the present invention. As will be discussed in more detail below, the device 10 is intended primarily for use in automotive or vehicular applications, and is capable of performing multiple functions in relation to the internal combustion engine of the vehicle and fuel system associated therewith, including fuel injector cleaning, engine decarbonizing, and fuel pressure checks.

Figure 1B:
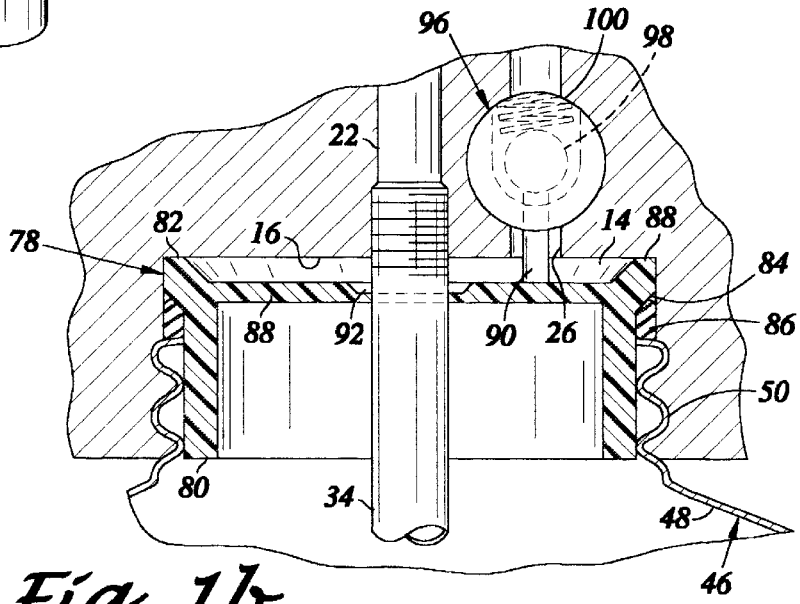
FIG. 1*b* is a partial cross-sectional view illustrating the manner in which the safety cap of the canister functions to actuate the safety check valve of the present cleaning and pressure check device to its open position.
Figure 2:
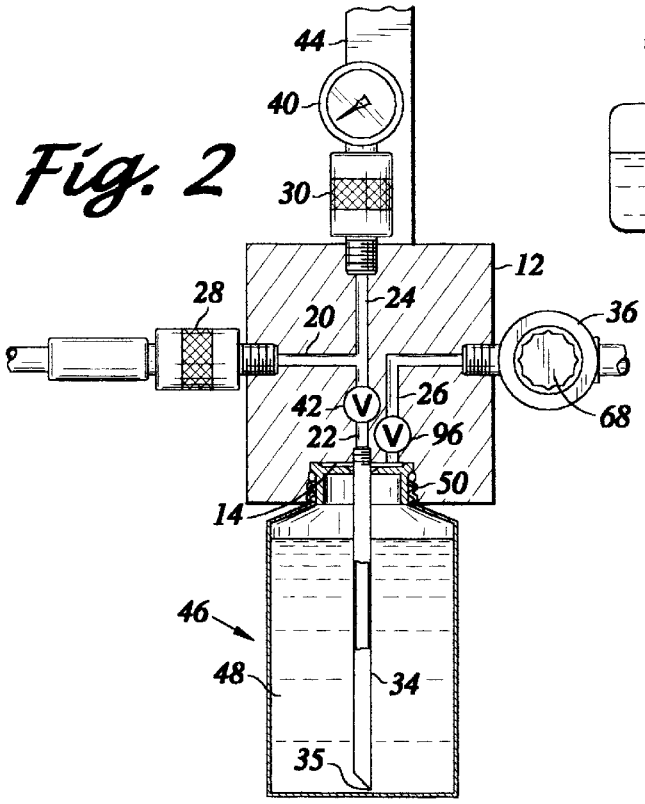
FIG. 2 is a cross-sectional view of the manifold body of the cleaning and pressure check device shown in FIG. 1.

When the device 10 is used for fuel injector cleaning or engine decarbonizing, the same is preferably used in conjunction with a canister 46 which is of a standard size and configuration, and filled with either a fuel injector cleaning fluid or an engine decarbonizing solvent. More particularly, as seen in FIGS. 1, 1*b* and 2, the canister 46 includes a cylindrically configured main body portion 48 which transitions to an externally threaded neck portion 50. The canister 46 is preferably provided with a safety cap 78 which is shown in FIGS. 1, 1*a*, 1*b* and 2. The safety cap 78 is circularly configured, and includes an annular lower flange portion 80 which is insertable into the neck portion 50 of the canister 46 and rigidly mounted therewithin. In addition to the lower flange portion 80, the safety cap 78 includes an annular upper flange portion 82 which has a diameter exceeding that of the lower flange portion 80 and defines a beveled bottom surface 84. Abutted against and extending about the bottom surface 84 is an O-ring 86 of the safety cap 78. The lower and upper flange portions 80, 82 protrude from opposite sides of a main web portion 88 of the safety cap 78. The safety cap 78 further includes a circularly configured puncture region 92 which is disposed at the axis or center of the main web portion 88 and is defined by a thin-walled section thereof. The safety cap 78, other than for the O-ring 86, is preferably fabricated from a plastic material. The O-ring 86 itself is preferably fabricated from a resilient material such as rubber. The use of the puncture region 92 will be described in more detail below.

As indicated above, if the device 10 is used for fuel injector cleaning or engine decarbonizing, the canister 46, in addition to being provided with the safety cap 78, will be filled with either fuel injector cleaning fluid or an engine decarbonizing solvent. If the device 10 is used for conducting a fuel pressure check, the canister 46 will be an empty bleed can which is preferably fabricated from either a transparent or semi-transparent material, and is also provided with the above-described safety cap 78. Though not shown, despite the safety cap 78 being inserted into the neck portion 50 of the canister 46, the neck portion 50 and safety cap 78 are preferably covered by a lid member which is threadably engaged to the neck portion 50.

Referring now to FIGS. 1 and 2, in the preferred embodiment, the device 10 comprises a generally cubic manifold body 12 which is preferably fabricated from a metal material resistant to corrosion or degradation when exposed to chemical solutions including fuel injector cleaning fluids and engine decarbonizing solvents. Disposed within one of the faces of the manifold body 12 is an internally threaded recess 14, a portion of which is defined by a generally circular inner wall 16 of the manifold body 12. Additionally, extending through the manifold body 12 is a first fluid duct 18 which has a generally T-shaped configuration. More particularly, the first fluid duct 18 defines first and third segments 20, 24 which extend to respective faces of the manifold body 12, and a second segment 22 which extends to the inner wall 16 of the manifold body 12. The first and third segments 20, 24 each enlarge into an internally threaded bore which is disposed within a respective face of the manifold body 12. Similarly, the second segment 22 enlarges into an internally threaded bore which is disposed within the inner wall 16 at the axis or center thereof. As seen in FIG. 2, the first, second and third segments 20, 22, 24 of the first fluid duct 18 also meet at a junction within the interior of the manifold body 12, and thus fluidly communicate with each other.

In addition to the first fluid duct 18, extending through the manifold body 12 is a second fluid duct 26 which has a generally L-shaped configuration. One end of the second fluid duct 26 extends to the inner wall 16 of the manifold body 12, with the opposite end thereof enlarging into an internally threaded recess which is disposed within one of the faces of the manifold body 12.

The device 10 also includes identically configured first and second coupling members 28, 30, each of which preferably comprises a quick-connect type coupling. The first coupling member 28 is rigidly attached to the manifold body 12 via the threadable receipt of an externally threaded tubular stem thereof into the complementary, internally threaded recess defined by the enlarged portion of the first segment 20 of the first fluid duct 18. Similarly, the second coupling member 30 is rigidly attached to the manifold body 12 via the threadable receipt of the externally threaded tubular stem thereof into the complementary, internally threaded recess defined by the enlarged portion of the third segment 24 of the first fluid duct 18. Releasably attachable to the first coupling member 28 is one end of an elongate fluid hose 32 which is placable into fluid communication with the first fluid duct 18 by the first coupling member 28. The use of the fluid hose 32 will also be discussed in more detail below.

The device 10 further comprises an elongate fluid tube 34. A portion of the fluid tube 34 adjacent one end thereof is externally threaded, with the opposite end having a beveled configuration so as to define a piercing tip 35. The fluid tube 34 is sized such that the externally threaded portion thereof is threadably receivable into the complementary, internally threaded recess defined by the enlarged portion of the second segment 22 of the first fluid duct 18. As seen in FIG. 2, the fluid tube 34, when threadably connected to the manifold body 12, extends axially from the inner wall 16 and in generally perpendicular relation to the face of the manifold body 12 having the recess 14 formed therein. The device 10 further comprises a pressure regulator 36 which is rigidly attached to the manifold body 12 via the threadable receipt of an externally threaded tubular stem portion thereof into the complementary, internally threaded recess defined by the enlarged portion of the second fluid duct 26. As such, the pressure regulator 36 fluidly communicates with the end of the second fluid duct 26 opposite that fluidly communicating with the recess 14. As will also be discussed in more detail below, the pressure regulator 36 is operable to selectively place the second fluid duct 26 into fluid communication with either a pressurized air source or ambient air. In this respect, FIGS. 1 and 3–5 depict an air hose 38 which extends from a pressurized air source and is releasably attached to a quick-connect coupling of the pressure regulator 36.

In addition to the above-described components, the device 10 includes a pressure gauge 40 which is releasably attached to the second coupling member 30 and placed into fluid communication with the first fluid duct 18 thereby. The releasable attachment of the pressure gauge 40 to the manifold body 12 via the second coupling member 30 allows for the quick and easy substitution of alternative pressure gauges within the device 10. Also included in the device 10 is a shut-off valve 42 which is partially encapsulated by the manifold body 12 and is disposed within the second segment 22 of the first fluid duct 18. The shut-off valve 42 is operable to selectively block or close off the flow of fluid between the fluid tube 34 and the first coupling member 28 for reasons which will also be discussed below. As best seen in FIG. 1, the manifold body 12 may optionally include a hanger member 44 which is attached thereto and used to suspend the same from a support structure such as a rod (as shown in FIGS. 1 and 3–5) or the hood of an automobile.

Referring now to FIGS. 1*b* and 2, the device 10 further includes a safety check valve 96 which is encapsulated within the manifold body 12, and is disposed within the second fluid duct 26. The safety check valve 96 comprises a ball member 98 which is normally seated against a portion of the second fluid duct 26 adjacent the recess 14 due to the biasing force exerted thereagainst by a biasing spring 100 of the safety check valve 96. Integrally connected to the ball member 98 and extending radially therefrom is an elongate push pin portion 90 which is sized so as to protrude into the interior of the recess 14. The safety check valve 96 is operable to selectively block the flow of fluid through the second fluid duct 26. More particularly, the safety check valve 96 is movable between a closed position whereat the flow of fluid through the second fluid duct 26 is blocked thereby, and an open position whereat the flow of fluid through the second fluid duct 26 is unobstructed. The operation of the safety check valve 96 will also be discussed in more detail below.

As best seen in FIG. 2, the attachment of the canister 46 to the manifold body 12 of the device 10 is accomplished by puncturing the piercable puncture region 92 of the safety cap 78 with the distal piercing tip 35 of the fluid tube 34, and thereafter advancing the fluid tube 34 into the interior of the canister 46. The puncture region 92 is sized relative to the fluid tube 34 such that when the fluid tube 34 is advanced therethrough, a slight gap is defined between the main web portion 88 of the safety cap 78 and the outer surface of the fluid tube 34. The externally threaded neck portion 50 of the canister 46 is then screwed into the recess 14 of the manifold body 12. As the neck portion 50 is threadably received into the recess 14, the push pin portion 90 which protrudes into the recess 14 is contacted by the top surface of the main web portion 88 and pushed or advanced thereby into that portion of the second fluid duct 26 adjacent the recess 14. As seen in FIG. 1*b*, the force of such advancement overcomes the biasing force exerted against the ball member 98 by the biasing spring 100 and results in the ball member 98 being unseated from the manifold body 12. The resultant unblocking of that portin of the second fluid duct 26 adjacent the recess 14 creates an unobstructed flow path between the pressure regulator 36 and the interior of the recess 14. Air entering the recess 14 via the second fluid duct 26 is able to flow into the interior of the canister 46 via the gap defined between the outer surface of the fluid tube 34 and the main web portion 88 of the safety cap 78.

As indicated above, when the canister 46 is attached to the manifold body 12 in the above-described manner, the fluid tube 34 of the device 10 extends into the interior of the canister 46. Importantly, the fluid tube 34 is preferably provided in a length wherein the distal piercing tip 35 thereof is disposed in relative close proximity to the bottom wall of the main body portion 48 of the canister 46 when the neck portion 50 thereof is fully threadably received into the recess 14. Additionally, the push pin portion 90 of the safety check valve 96 is itself preferably sized such that it will not be acted upon (i.e., forced upwardly) by the main web portion 88 of the safety cap 78 in the above-described manner until such time as the neck portion 50 of the canister 46 is fully threadably received into the recess 14 of the manifold body 12. The O-ring 86 of the safety cap 78 creates a fluid-tight seal between the neck portion 50, safety cap 78 and manifold body 12 when the canister 46 is fully threadably received into the recess 14.

As will be recognized from the foregoing, when the canister 46 is fully threadably received into the manifold body 12, the second fluid duct 26 fluidly communicates with the interior of the canister 46 via the recess 14 and gap between the fluid tube 34 and main web portion 88 due to the opening of the safety check valve 96 by the upward advancement of the push pin portion 90 in the aforementioned manner. Since the interior of the canister 46 may only be pressurized when the neck portion 50 is fully theadably received into the manifold body 12, accidental separation of the canister 46 from the manifold body 12 upon pressurization due to only a few threads of the neck portion 50 being engaged to the manifold body 12 is prevented in the device 10. As will be recognized, the attachment of the canister 46 to the manifold body 12 in the above-described manner occurs subsequent to the removal of any lid member from the neck portion 50.

Having thus described the structural attributes of the cleaning and pressure check device 10 of the present invention, the preferred methods of using the same in relation to fuel injector cleaning, engine decarbonizing, and fuel pressure check processes will now be discussed with reference to FIGS. 3–5.

Figure 3A:
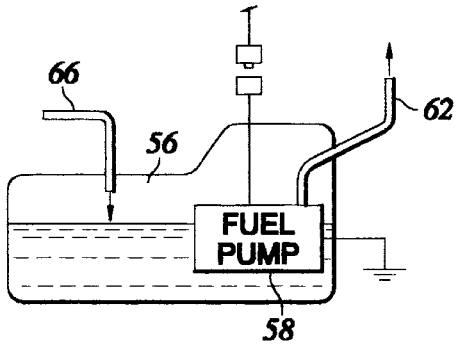
FIGS. 3 and 3*a* are plan views illustrating a preferred manner of using the cleaning and pressure check device of the present invention in relation to a fuel injector cleaning procedure.
Figure 3:
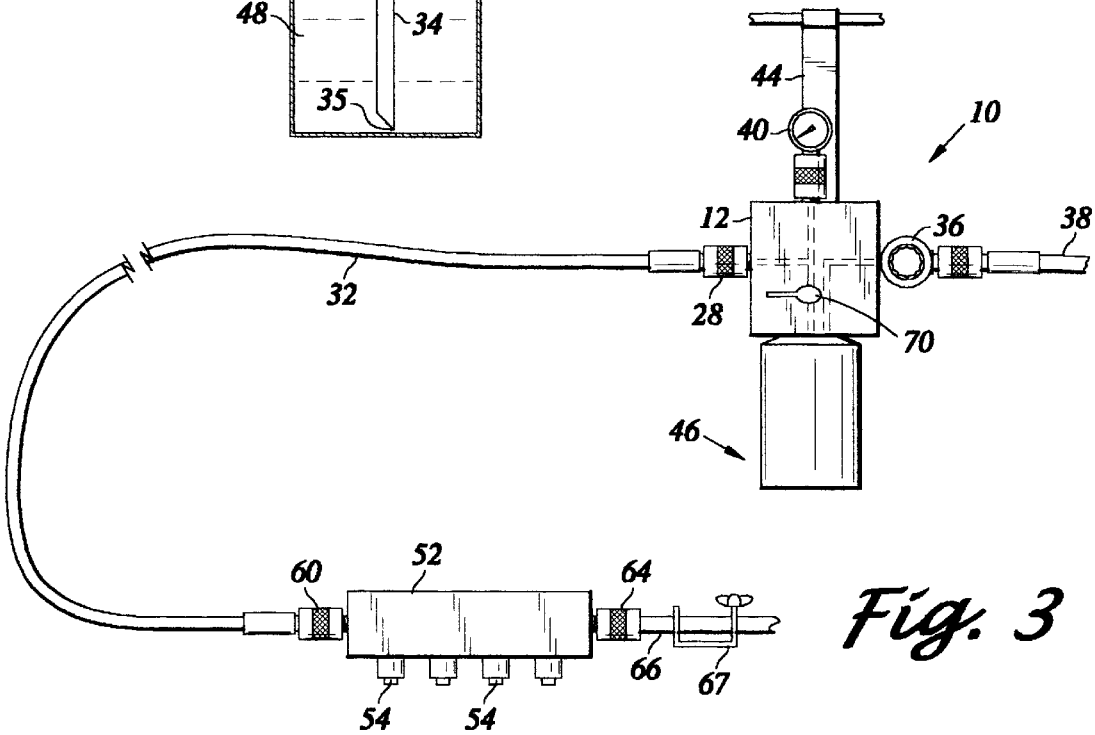

Referring now to FIGS. 3 and 3*a*, as previously indicated, the device 10 may be used for cleaning the fuel injectors of the fuel system for an internal combustion engine. The fuel system includes a fuel rail 52 which includes multiple fuel injectors 54 extending therefrom. In addition to the fuel rail 52, the fuel system includes the fuel tank 56 of the vehicle which includes a fuel pump 58 disposed therein. Fluidly connected to and extending between the fuel pump 58 and an inlet port 60 of the fuel rail 52 is a fuel line 62 of the fuel system. Additionally, fluidly connected to and extending between an outlet port 64 of the fuel rail 52 and the fuel tank 56 is a return line 66 of the fuel system. As will be recognized, the activation of the fuel pump 58 facilitates the circulation of gasoline or another fuel within the fuel tank 56 through the fuel rail 52 via the fuel and return lines 62, 66. The flow of fuel through the fuel rail 52 in turn results in the spraying thereof from the fuel injectors 54. The pressure at which the fuel is maintained within the fuel system, and hence the fuel rail 52 thereof, is dictated by the specifications of the vehicle and its internal combustion engine.

The method of cleaning the fuel injectors 54 through the use of the device 10 comprises the initial step of suspending the manifold body 12 from a support structure such as an automobile hood through the use of the hanger member 44 attached to the manifold body 12. Thereafter, a selected pressure gauge 40 is releasably attached to the second coupling member 30, with such selection being based on the pressure specifications of the vehicle for the fuel system and fuel rail 52 thereof. The pressure regulator 36 is then actuated to a closed position which is accomplished by the rotation of the handle 68 thereof in a counter-clockwise direction.

The closing of the pressure regulator 36 is followed by the actuation of the shut-off valve 42 to an open position which is accomplished by rotating the handle 70 thereof in a clockwise direction. Thereafter, the canister 46 which is filled with a quantity of fuel injector cleaning fluid and provided with the safety cap 78 is releasably attached to the manifold body 12 via the threadable receipt of the neck portion 50 into the recess 14 subsequent to the removal of the cap from the neck portion 50. As previously explained, such threadable engagement results in the extension of the fluid tube 34 of the device 10 into the interior of the canister 46, the opening of the safety check valve 96, and the placement of the second fluid duct 26 into fluid communication with the interior of the canister 46.

Subsequent to the attachment of the canister 46 to the manifold body 12 in the above-described manner, the air hose 38 extending from the pressurized air source is releasably attached to the quick-connect coupling of the pressure regulator 36. Thereafter, the manifold body 12, and in particular the first fluid duct 18 thereof, is fluidly connected to the fuel rail 52 of the fuel system. Such fluid connection is accomplished by releasably attaching one end of the fluid hose 32 to the first coupling member 28 and releasably attaching the other end of the fluid hose 32 to the inlet port 60 of the fuel rail 52 subsequent to the disconnection of the fuel line 62 therefrom. The return line 66 of the fuel system is then clamped-off via a clamp 67, with the fuel pump 58 of the fuel system then being disabled as shown in FIG. 3*a*.

Subsequent to the disabling of the fuel pump 58 of the fuel system, the pressure regulator 36 is actuated to an open position by rotating the handle 68 thereof in a clockwise direction. As will be recognized, the opening of the pressure regulator 36 causes air pressure to be exerted against the cleaning fluid in the canister 46 which forces the same into the fuel rail 52 via the fluid tube 34, second and first segments 22, 20 of the first fluid duct 18, and fluid hose 32. The flow of the cleaning fluid through the second segment 22 of the first fluid duct 18 is not restricted by the shut-off valve 42 due to the same having been previously been actuated to an open position. The pressure gauge 40 is also exposed to the pressurized cleaning fluid by the third segment 24 of the first fluid duct 18.

After the pressure regulator 36 has been opened, it is then adjusted or fine tuned as need to correlate the pressure reading provided by the pressure gauge 40 to a prescribed pressure level range for the fuel system and fuel rail 52 as indicated by the vehicle specifications. The engine is then started, with the pressure regulator 36 again being adjusted subsequent to the starting of the engine as needed to maintain the pressure reading of the pressure gauge 40 within the prescribed pressure level range.

Figure 4:
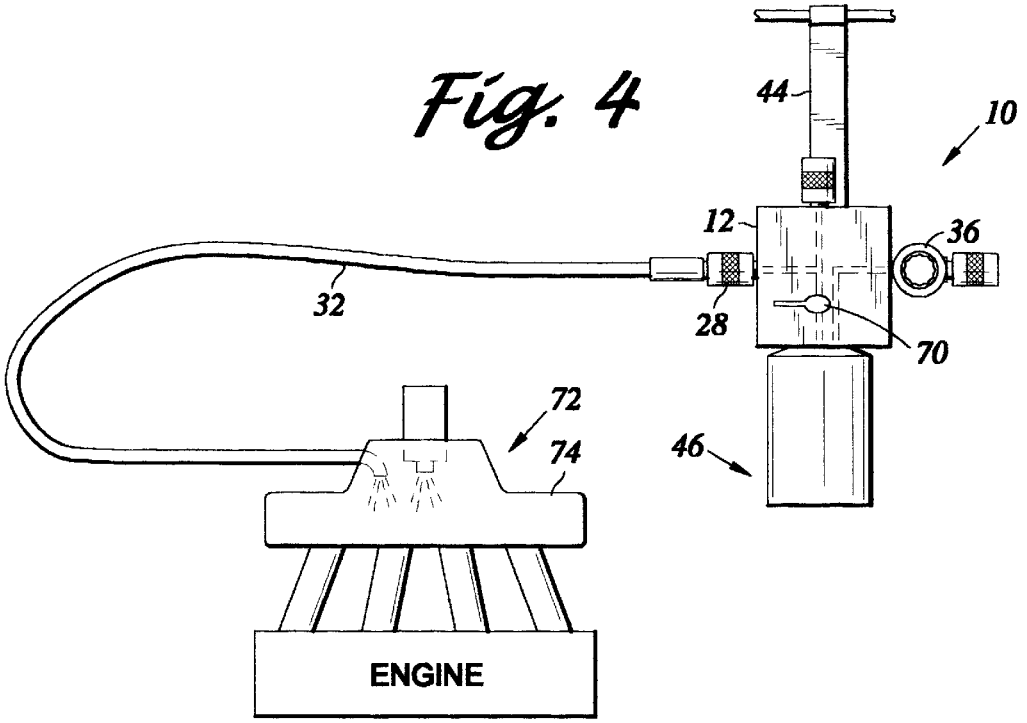
FIG. 4 is a plan view illustrating a preferred manner of using the cleaning and pressure check device of the present invention in relation to an engine decarbonizing procedure.

Referring now to FIG. 4, the method of decarbonizing the internal combustion engine 72 of a vehicle through the use of the device 10 comprises the initial step of suspending the manifold body 12 from a support structure such as an automobile hood through the use of the hanger member 44. Thereafter, the pressure regulator 36 is actuated to an open position which is accomplished by rotating the handle 68 thereof in a clockwise direction. A canister 46 filled with a quantity of decarbonizing solvent and provided with the safety cap 78 is then releasably attached to the manifold body 12 via the threadable receipt of the neck portion 50 into the recess 14 subsequent to the removal of the cap from the neck portion 50. Such threadable engagement results in the extension of the fluid tube 34 of the device 10 into the interior of the canister 46, the opening of the safety check valve 96, and the placement of the second fluid duct 26 into fluid communication with the interior of the canister 46.

Subsequent to the attachment of the canister 46 to the manifold body 12, the shut-off valve 46 is actuated to a closed position which is accomplished by rotating the handle 70 thereof in a counter-clockwise direction. The first fluid duct 18 of the manifold body 12 is then fluidly connected to the engine manifold 74 of the engine 72. Such fluid connection is accomplished by releasably attaching one end of the fluid hose 32 to the first coupling member 28 and releasably attaching the other end of the fluid hose 32 to the vacuum port of the engine manifold 74. The engine 72 is then started, with the shut-off valve 42 thereafter being slowly actuated to an open position by the rotation of the handle 70 in a clockwise direction so as to facilitate the flow of the decarbonizing solvent into the engine manifold 74. The decarbonizing solvent is drawn from the canister 46 into the engine manifold 74 via the fluid tube 34, second and first segments 22, 20 of the first fluid duct 18, and fluid hose 32 by the vacuum created by the starting of the engine 72.

In the engine decarbonizing method, no pressure gauge 40 need be attached to the second coupling member 30. The configuration of the second coupling member 30 prevents the escape of the engine decarbonizing solvent from within the first fluid duct 18 even when no pressure gauge 40 is releasably attached to the second coupling member 30. Additionally, the high pressure air hose 38 is not releasably attached to the quick-connect coupling of the pressure regulator 36 since the engine decarbonizing solvent is drawn from within the canister 46 by the vacuum created by the starting of the engine 72. However, the pressure regulator 36 is opened so as to allow air to be drawn into the canister 46 via the pressure regulator 36 and second fluid duct 26.

Figure 5:
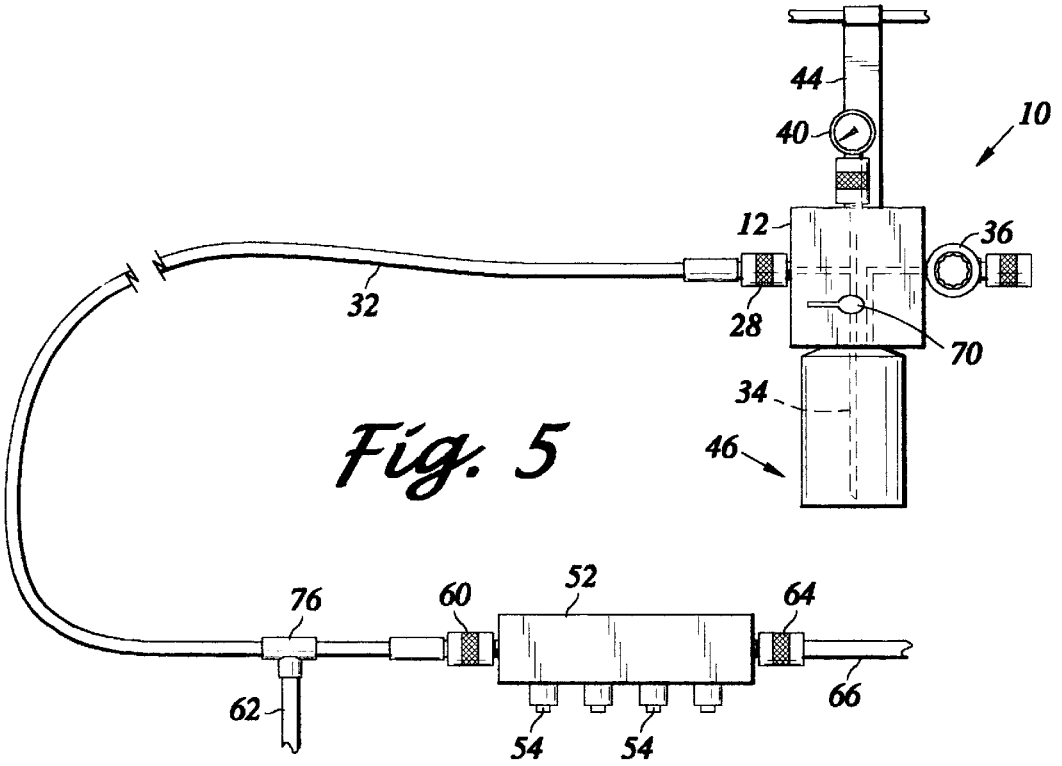
FIG. 5 is a plan view illustrating a preferred manner of using the cleaning and pressure check device of the present invention in relation to a fuel pressure check procedure.

Referring now to FIG. 5, the method of checking the pressure of the fuel system through the use of the device 10 comprises the initial step of suspending the manifold body 12 from a support structure such as an automobile hood through the use of the hanger member 44. Thereafter, a selected pressure gauge 40 is releasably attached to the second coupling member 30, with such selection being based on the pressure specifications of the vehicle for the fuel system thereof. The shut-off valve 42 is then actuated to a closed position which is accomplished by rotating the handle 70 thereof in a counter-clockwise direction.

The closing of the shut-off valve 42 is followed by the releasable attachment of the empty bleed canister 46 including the safety cap 78 to the manifold body 12 via the threadable receipt of the neck portion 50 thereof into the recess 14. Such threadable engagement results in the extension of the fluid tube 34 into the interior of the canister 46, the opening of the safety check valve 96, and the placement of the second fluid duct 26 into fluid communication with the interior of the canister 46.

Subsequent to the attachment of the canister 46 to the manifold body 12, the pressure regulator 36 is actuated to an open position by rotating the handle thereof in a clockwise direction. The first fluid duct 18 of the manifold body 12 is then fluidly connected to the fuel rail 52 and the fuel line 62 of the fuel system. Such fluid connection is accomplished by releasably attaching one end of the fluid hose 32 to the first coupling member 28 and releasably attaching the other end of the fluid hose 32 to a T-connector 76. The T-connector 76 is itself releasably attached to the inlet port 60 of the fuel rail 52 subsequent to the disconnection of the fuel line 62 therefrom, with the fuel line 62 itself being releasably attached to the T-connector 76. The engine is then started.

After the engine has been started, the shut-off valve 42 is actuated to an open position by rotating the handle 70 thereof in a clockwise direction. The opening of the shut-off valve 42 bleeds off air from within the fluid hose 32 and first fluid duct 18, and causes such air to flow into the interior of the canister 46 and out to ambient air via the second fluid duct 26 and open pressure regulator 36. Upon the visual observation of the flow of fuel or gasoline into the canister 46, the shut-off valve 42 is actuated back to the closed position by rotating the handle 70 in a counter-clockwise direction. Thereafter, a pressure reading provided by the pressure gauge 40 is correlated to the prescribed fuel pressure range for the fuel system. As will be recognized, to assist in the visual observation of the flow of fuel thereinto, the bleed canister 46 is preferably fabricated from a transparent or semi-transparent material.

Since the canister 46 with which the device 10 is used may be pre-filled with either the fuel injector cleaning fluid or engine decarbonizing solvent, the need to pour these highly flammable and corrosive products from one container to another is avoided through the use of the device 10. Additionally, the inclusion of the safety cap 78 with the canister 46 avoids the exposure of the user of the device 10 to the harmful fumes of these particular products. The source of pressurized air for the device 10 is simple shop air, which is already present in most automotive businesses. The inclusion of the first and second coupling members 28, 30 on the manifold body 12 allows for the connection/disconnection of the fluid hose 32 and/or pressure gauge 40 therefrom without disturbing the connection(s) of the canister 46 and/or air hose 38 thereto. The inclusion of the shut-off valve 42 in the manifold body 12 allows for use of the device 10 for the engine decarbonizing and fuel system pressure check procedures, in addition to the fuel injector cleaning procedure.

Thus, the device 10 has the advantages of being compact, easy to use, and inexpensive to manufacture, while substantially eliminating the risk of spilling the highly flammable and corrosive cleaning/decarbonizing fluids since they need not be transferred from one container to another. Additionally, as indicated above, the exposure of the user of the device 10 to the fumes from the cleaning/decarbonizing fluids is substantially avoided due to the inclusion of the safety cap 78 in the canister 46. The device 10 further extends the life of the pressure regulator 36 since the configuration of the manifold body 12 effectively isolates the pressure regulator 36 from exposure to the cleaning/decarbonizing fluids.

Additional modifications and improvements of the present invention may also be apparent to those of ordinary skill in the art. Thus, the particular combination of parts and steps described and illustrated herein is intended to represent only one embodiment of the present invention, and is not intended to serve as limitations of alternative devices within the spirit and scope of the invention.

What is claimed is:

1. A cleaning and pressure check device for placing the interior of a canister into fluid communication with an internal combustion engine via a fluid hose, the cleaning and pressure check device comprising:

a manifold body having first and second fluid ducts extending therethrough;

a first coupling member attached to the manifold body, the fluid hose being releasably attachable to the first coupling member and placeable into fluid communication with the first fluid duct thereby;

an elongate fluid tube attached to and extending from the manifold body, the fluid tube being fluidly connected to the first fluid duct;

a pressure gauge attached to the manifold body and fluidly connected to the first fluid duct;

a pressure regulator attached to the manifold body and fluidly connected to the second fluid duct, the pressure regulator being operable to selectively place the second fluid duct into fluid communication with at least one of a pressurized air source and ambient air;

a shut-off valve disposed within the manifold body and operable to selectively block the flow of fluid between the fluid tube and the first coupling member; and a safety check valve disposed within the manifold body and operable to selectively block the flow of fluid through the second fluid duct;

the manifold body being configured to permit the releasable attachment of the canister thereto in a manner wherein the fluid tube extends into the interior of the canister and the second fluid duct is in fluid communication therewith.

2. The cleaning and pressure check device of claim 1 further comprising a hanger member attached to the manifold body for suspending the manifold body from a support structure.

3. The cleaning and pressure check device of claim 1 wherein the pressure gauge is releasably attached to a second coupling member which is attached to the manifold body and places the pressure gauge into fluid communication with the first fluid duct.

4. The cleaning and pressure check device of claim 3 wherein the first and second coupling members each comprise a quick-connect coupling.

5. The cleaning and pressure check device of claim 1 wherein:

the safety check valve is disposed within the second fluid duct and movable between a closed position whereat the flow of fluid through the second fluid duct is blocked thereby and an open position whereat the flow of fluid through the second fluid duct is unobstructed;

the manifold body being configured such that the attachment of the canister thereto facilitates the movement of the safety check valve to the open position such that fluid may flow between the pressure regulator and the interior of the canister via the second fluid duct.

6. The cleaning and pressure check device of claim 5 wherein the canister includes an externally threaded neck portion and the manifold body includes an internally threaded recess formed therein which circumvents the fluid tube and is sized to threadably receive the neck portion for facilitating the releasable attachment of the canister to the manifold body, the second fluid duct being in fluid communication with the interior of the recess.

7. The cleaning and pressure check device of claim 6 further in combination with a safety cap which is mounted within the neck portion of the canister and comprises:

a main web portion which is adapted to facilitate the movement of the safety check valve to the open position when the neck portion is fully threadably received into the recess; and a puncture region which is disposed in the main web portion and piercable by the fluid tube for allowing the fluid tube to be advanced through the safety cap into the interior of the canister.

8. The cleaning and pressure check device of claim 7 wherein the safety cap further comprises an O-ring for forming a fluid-tight seal against the manifold body when the neck portion is threadably received into the recess.

9. The cleaning and pressure check device of claim 1 wherein:

the first fluid duct defines a first segment which fluidly communicates with the first coupling member, a second segment which fluidly communicates with the fluid tube, a third segment which fluidly communicates with the pressure gauge, and a junction whereat the first, second and third segments fluidly communicate with each other; and the shut-off valve is disposed within the second segment of the first fluid duct.

* * * * *